US006155425A

United States Patent [19]

You

[11] Patent Number: 6,155,425

[45] Date of Patent: Dec. 5, 2000

[54] INK-SLAB FOR CALLIGRAPHY

[76] Inventor: Jiun Feng You, No. 21, Alley 9, Lane 27, Sec. 5, Min Sheng E. Rd., Taipei, Taiwan

[21] Appl. No.: 09/430,704

[22] Filed: Oct. 29, 1999

[51] Int. Cl.[7] ..... B41J 27/00

[52] U.S. Cl. ..... 206/575; D19/78; D19/79; 206/1.7; 312/232

[58] Field of Search ..... D19/78, 79, 92–94; 15/257.07, 257.072, 257.073, 257.074, 257.075, 257.076; 40/358; 108/26.2; 206/1.7–1.9, 214, 224, 371, 575; 211/69.2; 220/379; 222/576, 577; 248/127, 128, 146; 312/232

[56] References Cited

U.S. PATENT DOCUMENTS

| | | | |
|---|---|---|---|
| D. 47,495 | 6/1915 | Numan | D19/93 |
| D. 173,818 | 1/1955 | Rogers | D19/78 |
| D. 202,393 | 9/1965 | Wallerstein et al. | D19/79 |
| 437,854 | 10/1890 | Garrow | 312/232 |
| 1,087,118 | 2/1914 | Hall | 40/358 |
| 1,347,527 | 7/1920 | Weeks | 222/577 |
| 2,741,048 | 4/1956 | Shelton | 206/1.7 |
| 3,389,945 | 6/1968 | Thomas | 206/1.7 |

*Primary Examiner*—Jim Foster
*Attorney, Agent, or Firm*—Rosenberg, Klein & Lee

[57] ABSTRACT

The present invention provides an ink-slab for calligraphy, wherein a hollow case is formed. A baffle partitions the space of the case into a water tank and an ink tank. Each tank has an opening. The openings of the water tank and the ink tank extend upwards to form necks and are installed slantingly along the direction of hair arrangement and ink scraping. Using so integrated but still separate design, the user can select to moisten a hair pencil with ink or dilute or wash it with water according to necessity. Hair arrangement will be more smooth and the scraped ink can be prevented from spilling out of the opening. An accommodation tank is formed in the case and a case cover is matched with the accommodation tank. Tissue papers can be placed in the accommodation tank to be taken along with the ink-slab. Concavity grooves are formed on the bottom edges of side walls of the cover for the accommodation tank. Hair pencils can be placed on the concavity grooves when the cover is placed upside down. A positioning groove formed by a pair of L-shaped positioning plates is installed on one side of the ink-slab. Bottle caps can be lapped in the positioning groove and a seat for pen cap can be appended for inverse inserting of pen caps.

10 Claims, 4 Drawing Sheets

INK-SLAB FOR CALLIGRAPHY

FIELD OF THE INVENTION

The present invention relates to an ink-slab and, more particularly, to an ink-slab for calligraphy, which integrates many functions and structures related to using hair pencils into a case so as to enhance convenience and cleanliness of calligraphic writing or painting.

BACKGROUND OF THE INVENTION

The conventional stationery for supplying ink for calligraphy is an ink-slab having an ink-stick to be ground with water or an ink bottle having ready-made ink therein. Advantages of using the ink-slab include that placid mood can be achieved when grinding the ink-stick and that there are generally separated water region and ink region. However, the limit between these two regions is ambiguous. Water may mix with ink such that discrimination between functions of washing with water or moistening with ink vanishes. Using the ink bottle can dispense with the trouble of ink-stick grinding. But a separate container such as a pot or a cup must be provided for supplying water, resulting in inconvenient usage.

Moreover, the pencil hair is usually scraped a few times at the ink-slab edge or the opening of the ink bottle because of excess ink or deranged pencil hair when moistening a hair pencil with ink. Owing to too large the relative angle, scraped ink will spill out such that the ink-slab edge or the periphery of the opening will be very dirty.

Also, ink is liquid such that it can easily blot hands or tablets. If tissue papers can be supplied, better cleanliness effect can be achieved. However, the conventional ink-slab or ink bottle does not supply units for accommodating tissue papers.

Furthermore, the conventional ink-slab or ink bottle does not have structures for temporarily placing hair pencils, pen caps, or bottle caps. The user usually has trouble of finding places for placing them. If they are arbitrarily placed, clothes, bodies, or other articles may be easily blotted due to rolling around of them.

SUMMARY AND OBJECTS OF THE PRESENT INVENTION

Accordingly, the primary object of the present invention is to provide an ink-slab for calligraphy having both functions of moistening a hair pencil with ink and diluting or washing a hair pencil with water, wherein a hollow case is formed. A baffle partitions the space of case into a water tank and an ink tank. Each tank has an opening. Using so integrated but still separate design, the user can select to moisten a hair pencil with ink or dilute or wash a hair pencil with water according to necessity, resulting in very convenient usage.

Another object of the present invention is to provide an ink-slab for calligraphy, which facilitates arrangement of pen hair and scraping off of excess ink such that scraped ink does not spill out. The openings of the water tank and the ink tank extend upwards to form necks and are formed slantingly along the direction of hair arrangement and ink scraping. Hair arrangement will be more smooth and the scraped ink can be prevented from spilling out of the opening, resulting in convenient and clean usage.

Yet another object of the present invention is to provide an ink-slab for calligraphy capable of maintaining cleanliness at any time, wherein an accommodation tank is formed in the case and a cover is matched with the accommodation tank. Tissue papers can be places in the accommodation tank to be taken along with the ink-slab.

Still yet another object of the present invention is to provide an ink-slab for calligraphy capable of positioning hair pencils, pen caps, and bottle caps such that they will not blot ambient articles. Concavity grooves are formed on the bottom edges of side walls of the cover for the accommodation tank. Hair pencils can be placed on the concavity grooves when the cover is placed upside down. A positioning groove formed by a pair of L-shaped positioning plates is installed on one side of the ink-slab. Bottle caps can be lapped in the positioning groove and a seat for pen cap can be appended for inverse inserting of pen caps.

The various objects and advantages of the present invention will be more readily understood from the following detailed description when read in conjunction with the appended drawings, in which:

DETAILED DESCRIPTION OF PREFERRED EMBODIMENT

Figure 1:
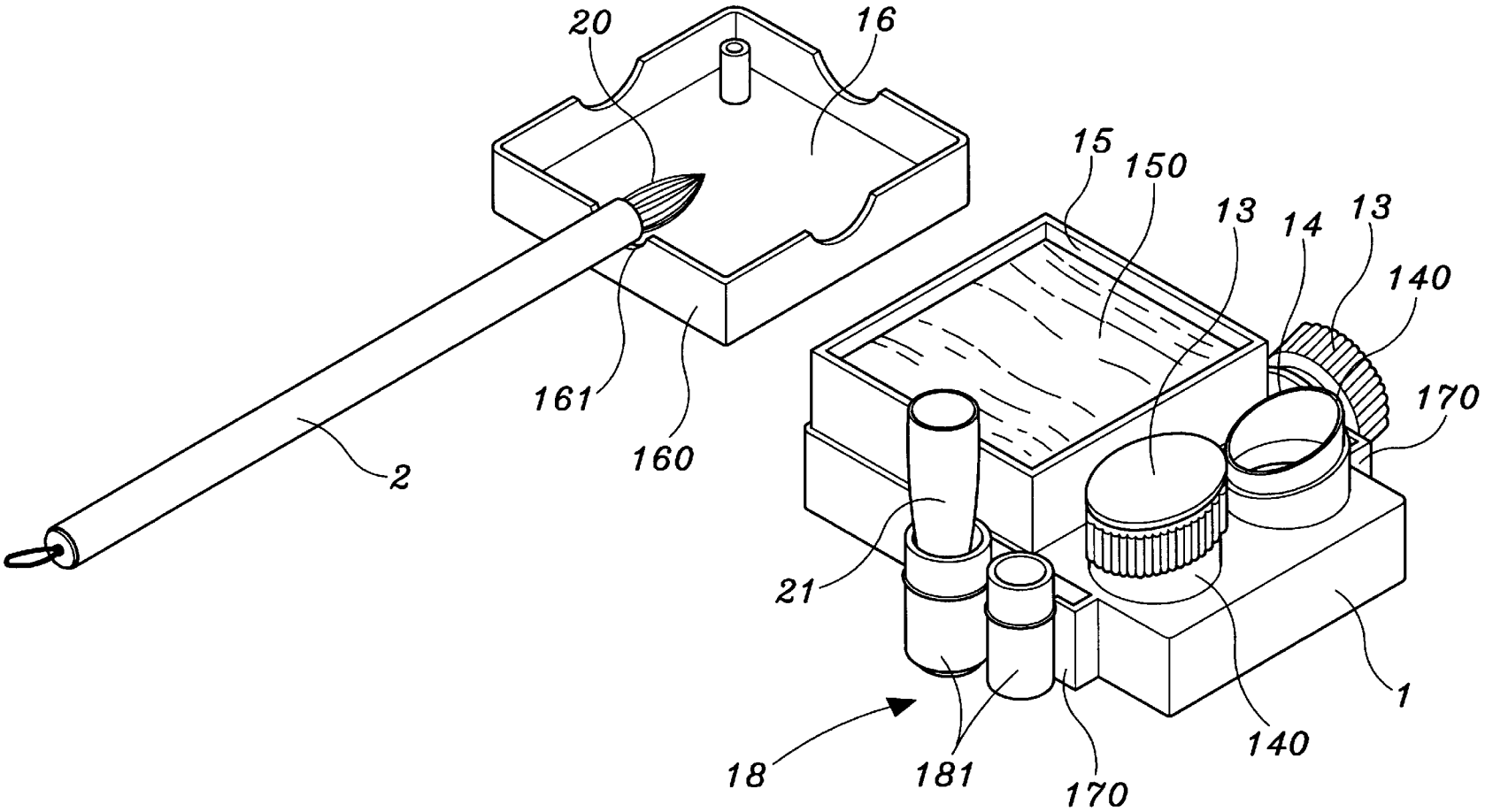
FIG. 1 is a perspective view showing an usage state of the ink-slab for calligraphy according to an embodiment of the present invention.

As shown in FIGS. 1 to 4, in an ink-slab for calligraphy of the present invention, a hollow case 1 is formed. A baffle 10 partitions the space of the case into an ink tank 11 and a water tank 12. Each tank has an opening 14 with a bottle cap 13. The openings 14 of the ink tank 11 and the water tank 12 extend upwards to form necks 140 for respectively replenishing or absorbing ink in the ink tank 11 and water in the water tank 12. Water and ink can be used independently but integrated in the same case 1. The user can select to moisten a hair pencil 2 with ink or dilute or wash the hair pencil 2 with water according to necessity, resulting in very convenient usage.

The openings 14 of the ink tank 11 and the water tank 12 extend upwards to form necks 140. An annular trench 130 is arranged at the bottom of the bottle cap 13 to match the opening 14 such that the bottle cap 13 can cover and thus close the opening 14. The opening 14 is formed slantingly along the direction of hair arrangement and ink scraping of the hair pencil 2. An scraping edge 141 is formed at high position of the opening 14. Hair arrangement or ink scraping of the hair pencil 2 at the scraping edge 141 will be more smooth because of smaller angle between the pencil hair 20 and the opening 14, and the scraped ink can be prevented from spilling out of the opening 14. Convenient and clean usage can thus be achieved.

An accommodation tank 15 is installed at the other side opposed to the opening 14 of the case 1, and a cover 16 is matched to cover on the accommodation tank 15. Sanitary ware such as tissue papers 150 can be placed in the accommodation tank 15 to be taken along with the ink-slab. The user has tissue papers 150 for cleaning when using the hair pencil 2. Clean usage is thus achieved.

Figure 2:
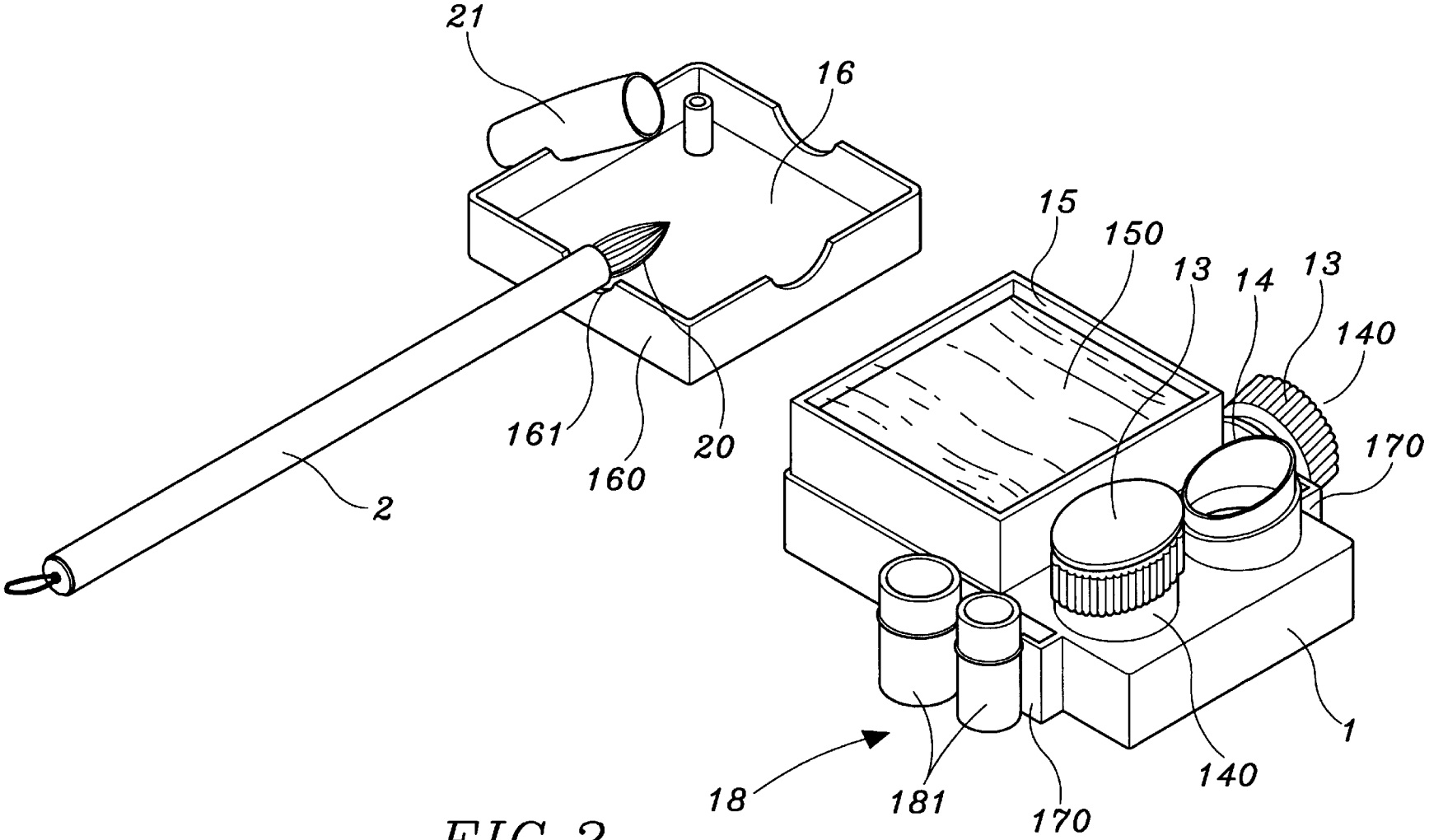
FIG. 2 is a perspective view showing another usage state of the ink-slab for calligraphy according to an embodiment of the present invention.
Figure 3:
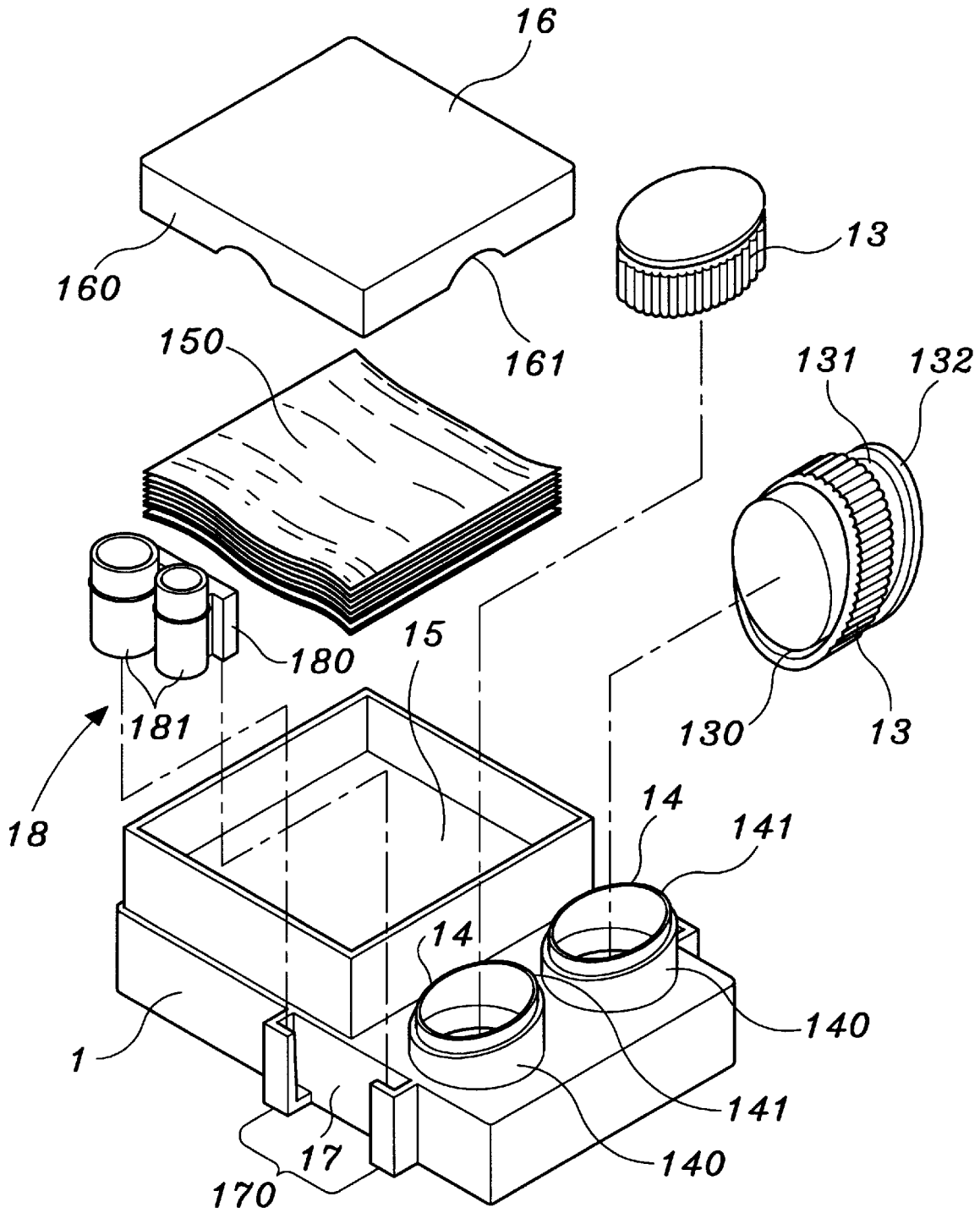
FIG. 3 is an exploded view of the ink-slab for calligraphy according to an embodiment of the present invention.
Figure 4:
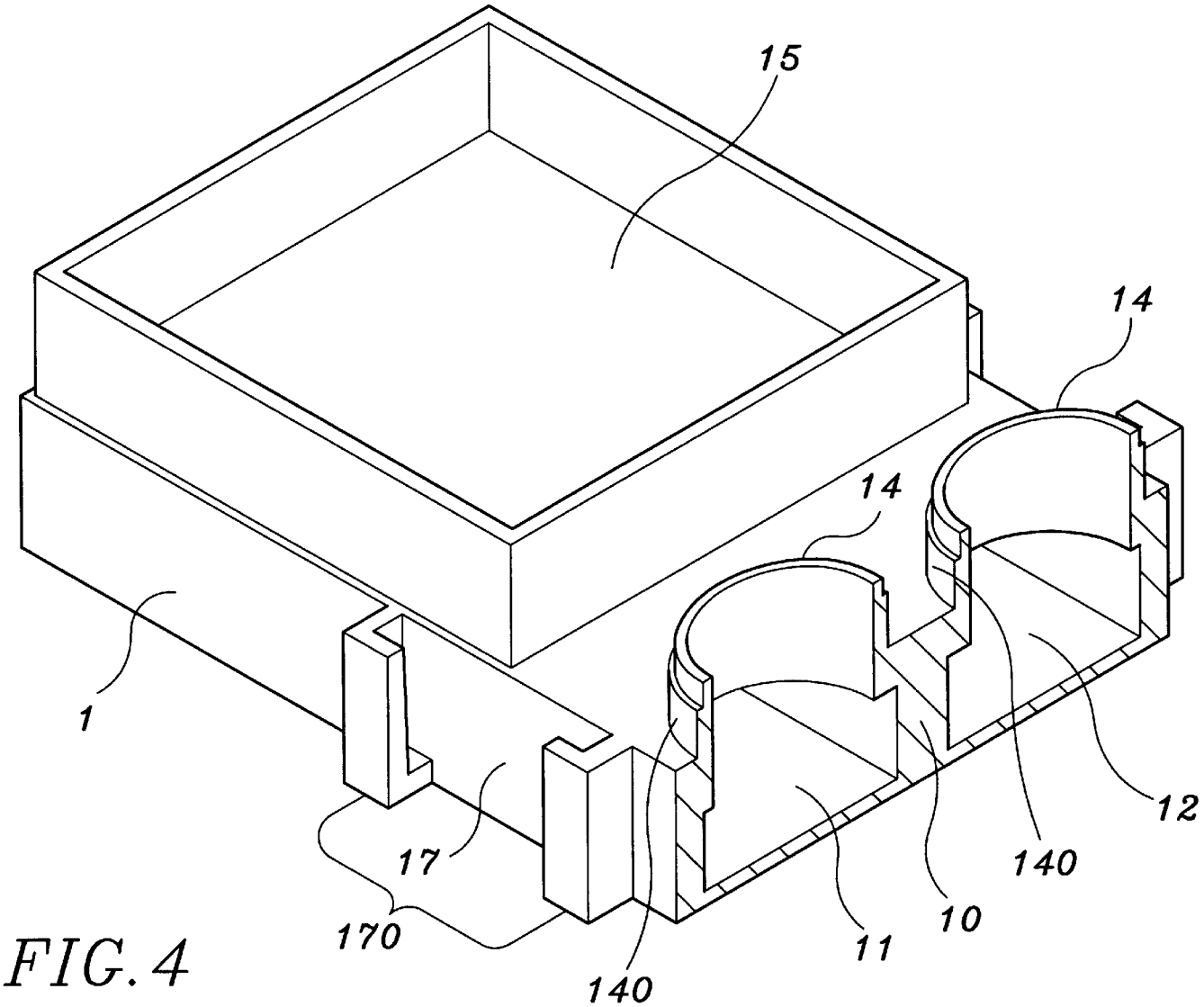
FIG. 4 is a partly cross-sectional perspective view of the ink-slab for calligraphy according to an embodiment of the present invention.

Concavity grooves 161 are formed on the bottom edges of side walls 160 of the cover 16. The hair pencil 2 moistened with ink or a pen cap 21 can be temporarily placed on a concavity groove 161 (as shown in FIGS. 1 and 2) or on two opposed concavity grooves 161 when the cover 16 is placed upside down. The hair pencil 2 can thus be positioned so as not to roll around such that the hair 20 moistened with ink will not blot ambient articles. A positioning groove 17 formed by a pair of L-shaped positioning plates 170 is installed on one side of the case 1 to prevent the hair pencil 2, the pen cap 21, and the bottle cap 13 from blotting ambient articles. Both transverse width and longitudinal depth of the positioning groove 17 decrease from upper part to lower part to let inserted objects be tightly positioned. An annular groove 131 and a corresponding projecting ring 132 are arranged at periphery near the top of the bottle cap 13. The bottle cap 13 uncapped from the opening 14 can be lapped in the positioning groove 17 via the projecting ring 132. As shown in FIG. 1, a seat 18 for pen cap comprising a fixing plate 180 and at least a pen holder 181 connected to the fixing plate 180 can be appended for inverse inserting of the pen cap 21 detached from the hair pencil 2. The pen cap 21 is thus positioned so as not to roll around.

To sum up, the present invention proposes an ink-slab, which integrates many functions and structures related to using hair pencils into a case so as to enhance convenience and cleanliness of calligraphic writing or painting.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An ink-slab for calligraphy comprising a hollow case, a single baffle partitioning an interior space of said case into a water tank and an ink tank, each said tank having an opening and a corresponding bottle cap formed adjacent a first end of said case, said case having an accommodation tank formed on an upper surface of said case adjacent a second end thereof for holding a supply of tissue papers therein, said case having at least one positioning groove formed on one side of said case for engagement of a respective one of said bottle caps subsequent to removal from a respective one of said openings.

2. The ink-slab for calligraphy of claim 1, further comprising a cover is dimensioned to form a closure for said accommodation tank and the tissue papers disposed therein.

3. The ink-slab for calligraphy of claim 2, wherein said cover has a concave groove formed at a bottom edge of at least one side wall of said cover for placing a hair pencil thereon.

4. An ink-slab for calligraphy comprising a hollow case, a baffle partitioning an interior space of said case into a water tank and an ink tank, each said tank having an opening and a corresponding bottle cap, said openings of said water tank and said ink tank extend upwards to form projecting necks, an annular trench being arranged at a bottom portion of each said bottle cap such that each said bottle cap is lapped in a respective one of said openings via said annular trench to close said opening.

5. The ink-slab for calligraphy of claim 4, wherein each of said openings is formed slantingly, each of said openings having a scraping edge for hair arrangement and ink scraping of a hair pencil formed at high position thereof.

6. An ink-slab for calligraphy comprising a hollow case, a baffle partitioning an interior space of said case into a water tank and an ink tank, each said tank having an opening and a corresponding bottle cap, said case having an accommodation tank formed on an upper surface of said case adjacent a second end thereof for holding a supply of tissue papers therein, said case having at least one positioning groove formed on one side of said case for engagement of a respective one of said bottle caps subsequent to removal from a respective one of said openings, said at least one positioning groove being installed on one side of said case being formed by a pair of vertically extended L-shaped positioning plates.

7. The ink-slab for calligraphy of claim 6, wherein each said bottle cap has an annular groove and a corresponding projecting ring formed at a periphery thereof near a top portion of said bottle cap, and said bottle cap receivable in said positioning groove for vertical positioning.

8. The ink-slab for calligraphy of claim 6, wherein said ink-slab further comprises a seat for receiving a pen cap, said seat comprising a fixing plate and at least one pen holder connected to said fixing plate, said seat receiving the pen cap of a hair pencil in an inverted orientation with said fixing board being lapped in said positioning groove between said two positioning plates.

9. The ink-slab for calligraphy of claim 7, wherein a transverse width of said positioning groove between said two positioning plates decreases from an upper part to a lower part.

10. The ink-slab for calligraphy of claim 7, wherein a longitudinal depth of said positioning groove between said two positioning plates decreases from an upper part to a lower part.

* * * * *